United States Patent [19]

Stroede et al.

[11] Patent Number: 4,975,078

[45] Date of Patent: Dec. 4, 1990

[54] MODULAR TELEPHONE CONNECTOR

[75] Inventors: Andrew J. Stroede, Oak Forest; Bruce W. Dawson, Orland Park, both of Ill.

[73] Assignee: Panduit Corp., Tinley Park, Ill.

[21] Appl. No.: 452,547

[22] Filed: Dec. 15, 1989

[51] Int. Cl.[5] ..... H01R 4/24

[52] U.S. Cl. ..... 439/405; 439/676; 439/417; 439/465

[58] Field of Search ..... 439/391–407, 439/676, 344, 417, 418, 465

[56] References Cited

U.S. PATENT DOCUMENTS

| | | | |
|---|---|---|---|
| 4,083,615 | 4/1978 | Volinskie . | |
| 4,261,633 | 4/1981 | Abernethy . | |
| 4,435,034 | 3/1984 | Aujla et al. | 439/404 |
| 4,488,768 | 12/1984 | Sigmon . | |
| 4,496,206 | 1/1985 | Markwardt et al. | 439/404 |
| 4,508,411 | 4/1985 | Hughes et al. . | |
| 4,545,635 | 10/1985 | Bunnell | 439/404 |
| 4,606,595 | 8/1986 | Dola | 439/404 |
| 4,648,678 | 3/1987 | Archer | 439/402 |
| 4,657,330 | 4/1987 | Levy . | |
| 4,738,635 | 4/1988 | Harrington et al. | 439/676 |

OTHER PUBLICATIONS

Installation instruction page for an AT&T modular plug (700A8) illustrating installation instructions for the AT&T modular plug (700A8).

*Primary Examiner*—David L. Pirlot

*Attorney, Agent, or Firm*—Charles R. Wentzel; Mark D. Hilliard

[57] ABSTRACT

A modular telephone connector includes a housing defining a standard telephone jack, a contact carrier that mounts a plurality of metal contacts each having resilient cantilever jack forming portions and insulation displacement portions and a wire positioning fixture having aligned first and second rows of wire guide channels. The connector is assembled by latching the contact carrier and contacts to the housing, positioning wires through first and second wire guide channels of the wire positioning fixture and securing the fixture to the housing and contact carrier with latch arms formed on the fixture. The insulation displacement portion of each contact is positioned in alignment with and between first and second wire guide channels to engage and terminate a wire positioned in the first and second wire guide channels.

31 Claims, 5 Drawing Sheets

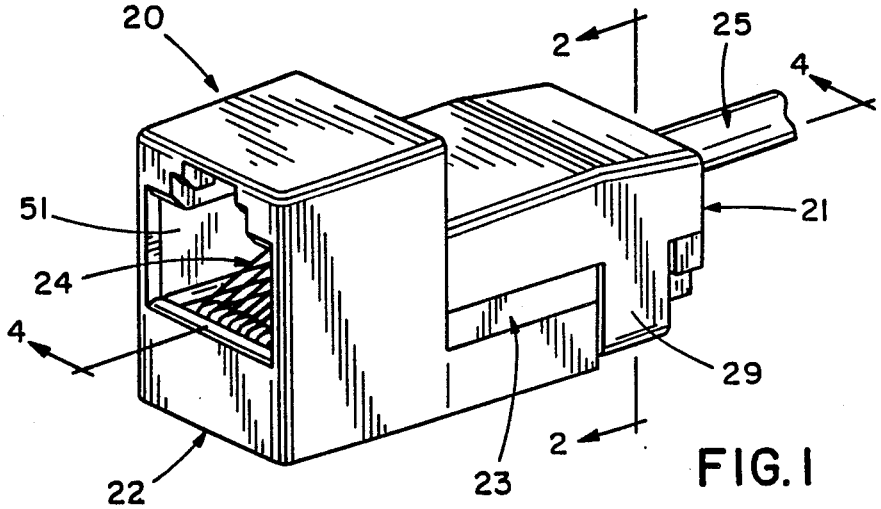
FIG. 1
FIG. 2
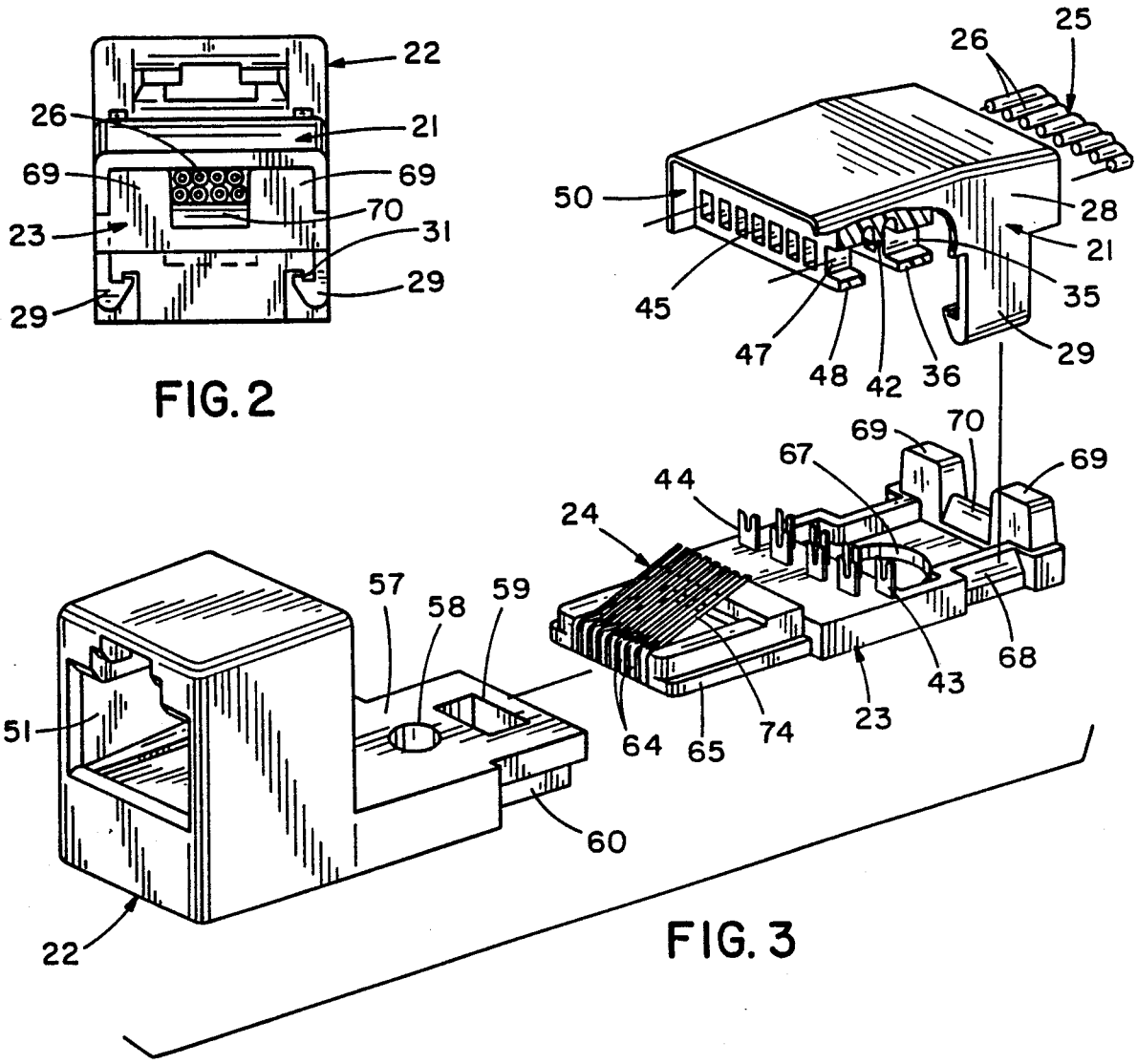
FIG. 3

MODULAR TELEPHONE CONNECTOR

TECHNICAL FIELD

The present invention relates to modular telephone connectors and specifically to a modular telephone jack having insulation displacement contacts allowing manual termination of the connector to individual wires of a telephone cable in the field without the use of special termination tools.

BACKGROUND ART

Various designs of field installable modular telephone connectors have been proposed. The desirable characteristics of a field installable telephone connector include a minimal size, maximal ease of manipulation of the wires into a termination position and maximal ease of assembly and termination of the connector.

A number of designs have proposed multipart connectors having a modular telephone jack or plug housing presenting a plurality of insulation displacement contacts for termination to individual conductors of a telephone cable. In the connector proposed in U.S. Pat. No. 4,261,633 pairs of wires are terminated in a plurality of barrel terminals by inserting the wires into each terminal with a special tool. In a similar connector, proposed in U.S. Pat. No. 4,508,411, wires are initially positioned in a slotted cover and then simultaneously terminated to a plurality of barrel terminals.

Other designs propose the use of a wire support or cover to initially position all of the wires to be terminated in open slots in the wire support. The wire support is then manipulated into engagement with a plurality of insulation displacement contacts projecting from the housing of the connector to terminate the wires to the connector. Reference may be had to U.S. Pat. Nos. 4,488,768 and 4,657,330.

Due to the size and close spacing of the adjacent wire positioning slots, manipulation of individual wires into the slots of the wire support of these proposed connectors and retention of the wires within the slots during manipulation of the wire support into engagement with the insulation displacement contacts of these connectors is difficult to reliably achieve.

Another plug connector utilizes a wire support having a plurality of cylindrical wire channels for positioning the wires prior to termination, each cylindrical wire channel having a diameter slightly greater than the diameter of the wire to allow close spacing of the wires to minimize the width of the connector. Each of the individual insulation displacement contact slots formed in the inner surface of the wire support communicate with a cylindrical wire channel. After insertion of the wires to be terminated into the cylindrical wire channels of the wire support, insulation displacement contacts positioned on the housing of the connector are aligned with the contact slots in the wire support and the wires are terminated by driving the wire support into the housing of the connector with a screw fastener. Manipulation of each wire through each respective small diameter cylindrical channel of the wire support can be difficult if the wires have any non-axial deformations. Also, the connector is difficult to assemble since the wire support must be screwed into engagement with the connector housing in order to overcome the high termination force of the connector.

The known field installable telephone connectors have not achieved the desirable characteristics of maximal ease of wire positioning, connector assembly and wire termination in a connector of minimal size and thus leave room for improvement in the art.

DISCLOSURE OF THE INVENTION

It is an object of the present invention to provide an improved modular telephone connector of minimal size that allows rapid and easy positioning of a plurality of telephone wires and manipulation of the connector parts to simultaneously terminate the wires in the field without the use of special assembly tools.

It is another object of the present invention to provide a connector having a mounting means that prevents disassembly and removal of the connector from the mounting surface.

These and other objects, together with the advantages thereof over existing prior art forms, which will become apparent from the following specification or accomplished by means hereinafter described.

In general, a modular telephone connector adapted for termination of a plurality of telephone wires includes a housing adapted to mate with a standard telephone connector; a plurality of metal contacts each having a first portion adapted to conductively engage corresponding terminals of the standard telephone connector and an insulation displacement portion adapted to terminate one of the telephone wires; contact carrier means for mounting the contacts to the housing with the insulation displacement portions disposed outwardly of the housing arranged in a plurality of spaced apart contact rows on an upper surface of the contact carrier means; and fixture means for positioning the wires with respect to the insulation displacement portions, the fixture means including a plurality of first wire guide channels formed in a first row on an inner surface of the fixture means, a plurality of second wire guide channels formed in a second row on the inner surface parallel to and spaced from the first row defining a continuous contact accepting slot therebetween, with the first and second wire guide channels in alignment to successively accept and position each wire for engagement with and termination to the insulation displacement portions of the contacts, anvil means for forcing the wires into conductive engagement with each respective insulation displacement portion, the anvil means formed on the inner surface of the fixture means between spaced apart first and second wire guide channels in a position to project between adjacent rows of insulation displacement portions and fastening means for securing the fixture means to the connector with the insulation displacement portion of each contact disposed in alignment with and between an aligned pair of first and second wire channels in a position to terminate a wire positioned in the first and second wire channels.

BRIEF DESCRIPTION OF THE DRAWING

FIG. 1 is an isometric view of a free standing modular telephone connector embodying the concept of the present invention;

FIG. 2 is a rear view of the connector of FIG. 1 as seen from line 2—2 of FIG. 1;

FIG. 3 is an exploded isometric view of the connector of FIG. 1;

PREFERRED EMBODIMENTS FOR CARRYING OUT THE INVENTION

Figure 4:
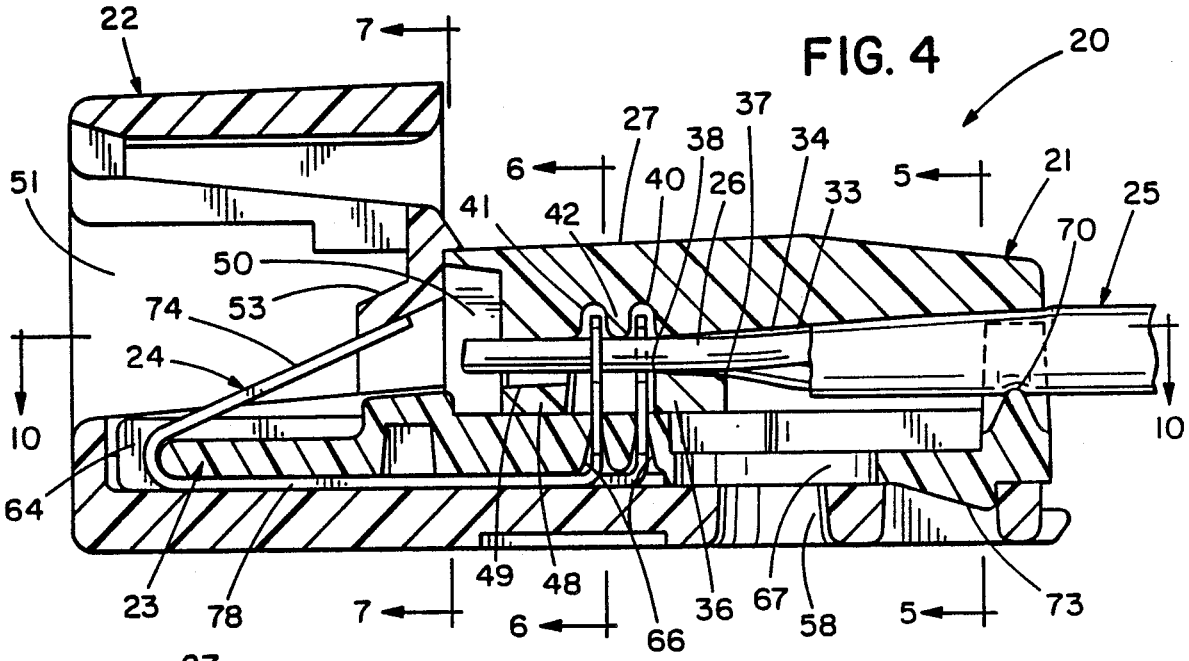
FIG. 4 is a sectional view taken along line 4—4 of FIG. 1.
Figure 5:
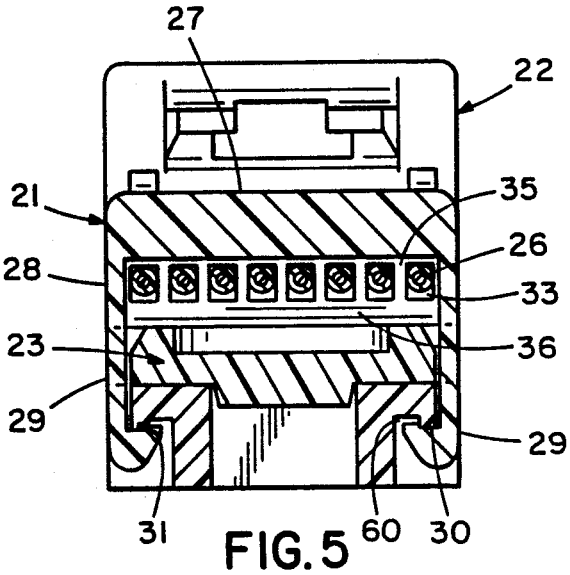
FIG. 5 is a sectional view taken along line 5—5 of FIG. 4, with a portion of the telephone cable removed for clarity.

A field installable free standing modular telephone connector embodying the concept of the present invention is designated generally by the numeral 20 in the accompanying drawings. Connector 20 includes a wire positioning fixture 21, a housing 22, a contact carrier 23 and a plurality of metal contacts 24. Housing 22 and contact carrier 23 are preferably each integrally molded of ABS plastic. Fixture 21 is preferably integrally molded of transparent polycarbonate plastic to facilitate placement of wires in the fixture.

Connector 20 is preferably utilized to terminate a standard telephone cable 25 having eight single conductor insulated telephone wires 26.

As best seen in FIGS. 3–6, wire positioning fixture 21 includes an outer surface 27, side walls 28 and opposed latch arms 29 each disposed on a respective side wall 28 projecting away from outer surface 27. Disposed at the distal end of each latch arm 29 is inwardly directed undercut locking slot 30 having an overhanging edge 31.

Eight rectangular wire guide channels 33 are formed on an inner surface 34 of wire positioning fixture 21 by seven parallel entry walls 35 formed perpendicular to inner surface 34 and an entry bridge 36 connecting the distal edges of side walls 28 and the distal edges of entry walls 35. See FIGS. 5 and 10. The rectangular section of each wire guide channel 33 is chosen to minimize the surface contact between a cylindrical wire and channel 33, thus, facilitating the ease of insertion of each wire 26 through each channel 33.

As best seen in FIG. 4, the height of each wire guide channel 33 tapers from a height of approximately 1¼ times the diameter of wire 26 between entry edge 37 of entry bridge 36 and inner surface 34 to slightly greater than the diameter of wire 26 between exit edge 38 and inner surface 34 of entry bridge 36. The tapered channels 33 facilitate insertion of wires 26 into channels 33 while accurately positioning each wire 26 as it exits channel 33.

Figure 10:
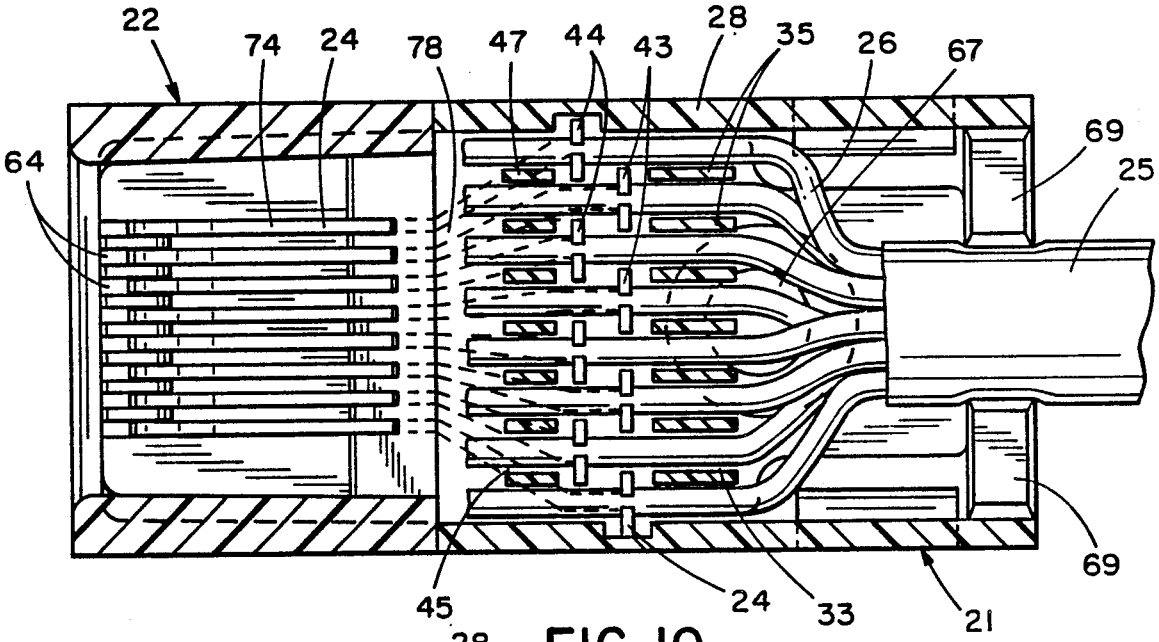
FIG. 10 is a sectional view taken along line 10—10 of FIG. 4.
Figure 11:
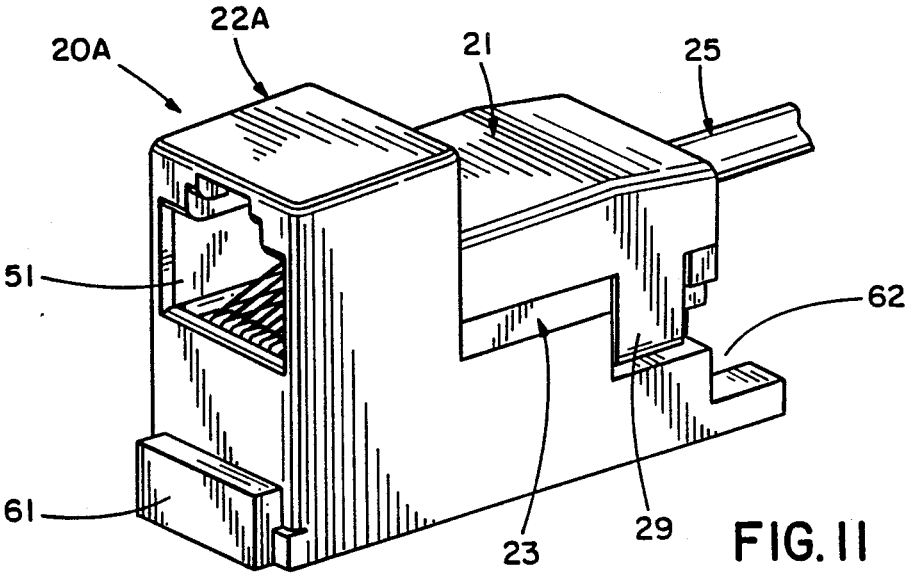
FIG. 11 is an isometric view of a communication box assembly connector embodying the concept of the present invention.
Figure 12:
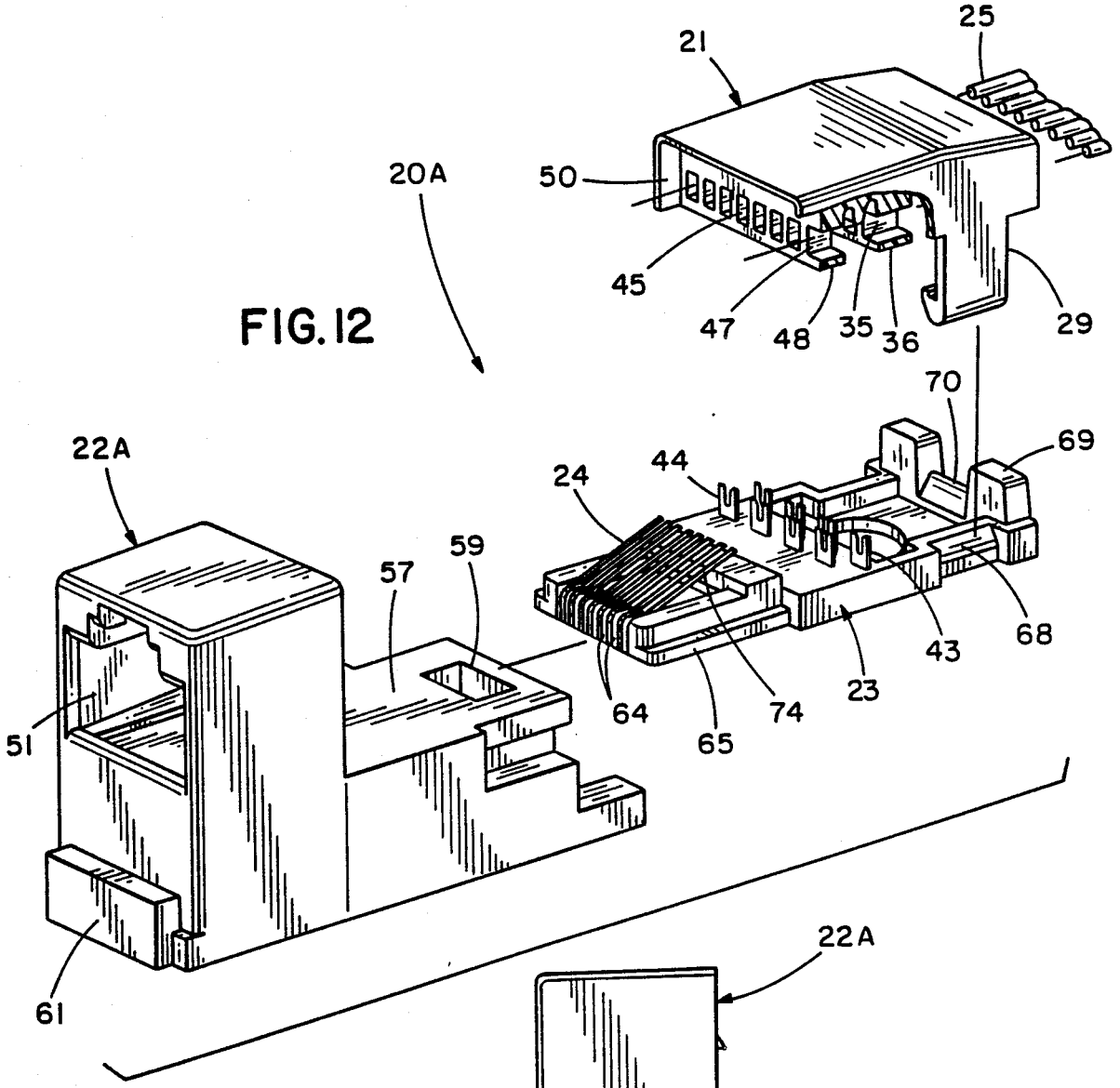
FIG. 12 is an exploded isometric view of the connector of FIG. 11.
Figure 13:
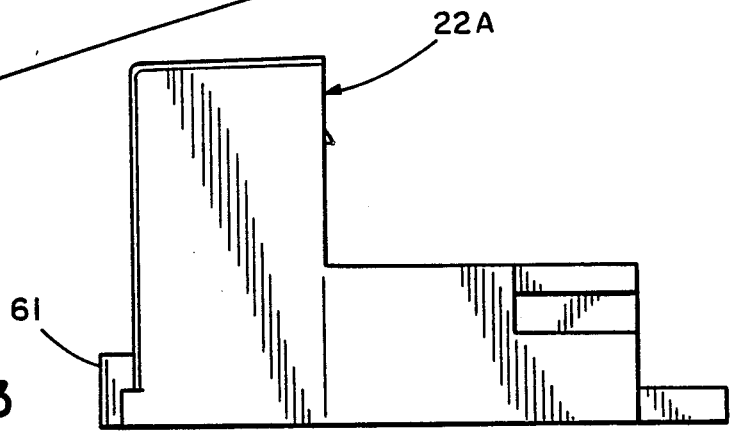
FIG. 13 is a side view of the housing of the connector of FIG. 11.
Figure 14:
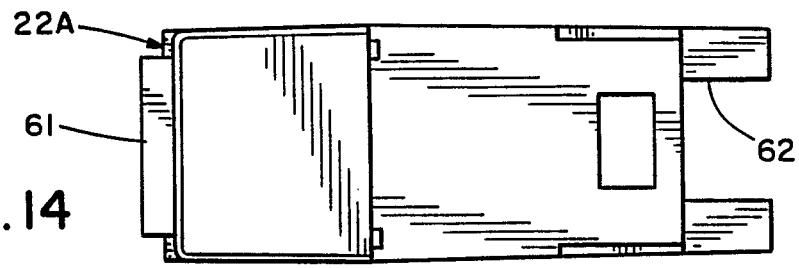
FIG. 14 is a plan of the housing of the connector of FIG. 11.
Figure 15:
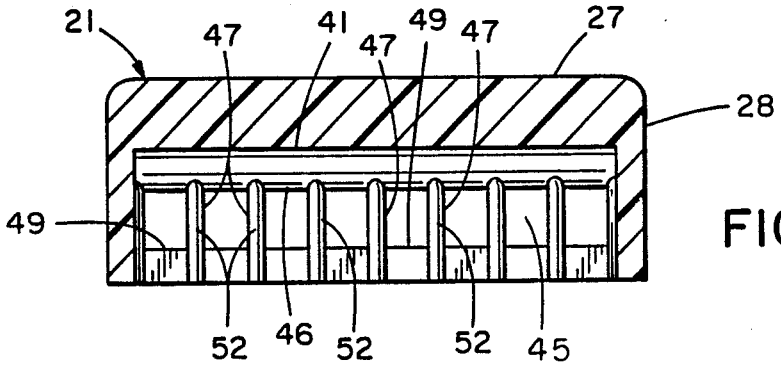
FIG. 15 is a sectional view taken along line 15—15 of FIG. 8.
Figure 16:
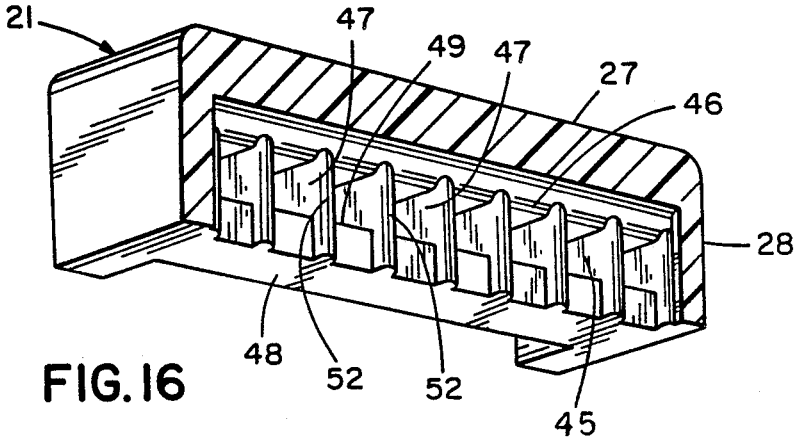
FIG. 16 is an isometric view of section of FIG. 15.
Figure 17:
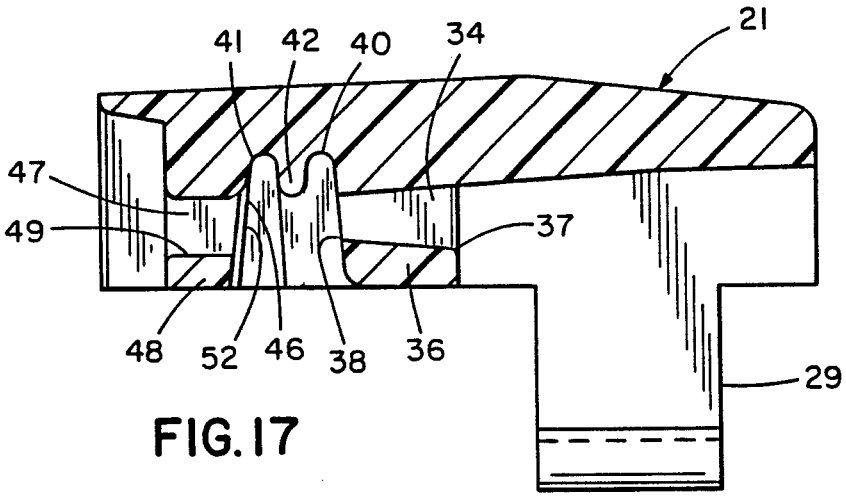
FIG. 17 is a sectional view taken along line 17—17 of FIG. 8.
Figure 18:
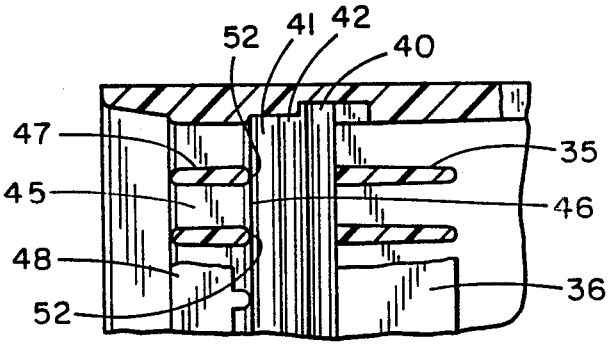
FIG. 18 is a fragmentary view partially in section of the wire positioning fixture of FIG. 8.

Disposed perpendicular to the wire guide channels 33 are parallel first and second contact slots 40 and 41 which define therebetween a wire anvil 42. As seen in FIGS. 1, 4 and 10, first and second contact slots 40 and 41 are disposed to respectively receive a rearward row 43 or a forward row 44 of the termination ends of contacts 24 positioned on the upper surface of contact carrier 23. Wire anvil 42 is disposed to engage the portion of each wire 26 positioned between forward and rearward contact rows 43 and 44 to force each wire into conductive engagement with each insulation displacement slot formed in the distal end of the termination end of each contact 24. Wire anvil 42 has a rounded contour with its distal edge being in alignment with the portions of inner surface 34 of fixture 21 on either side of anvil 42, which each respectively define the upper surfaces of wire guide channels 33 and 45. Thus, a wire inserted through guide channel 33 is unable to snag against wire anvil 42.

As seen in FIGS. 3, 4 and 10, eight rectangular second wire guide channels 45 are respectively formed in alignment with each of the wire guide channels 33 on inner surface 34 by seven parallel exit walls 47 formed perpendicular to inner surface 34 and a exit bridge 48 connecting the distal edges of side walls 28 and exit walls 47. As best seen in FIG. 4, the height of each second wire guide channel 45 is approximately 1¼ times the diameter of wire 26 with an inner exit bridge surface 49 of exit bridge 48 being disposed at a point below exit edge 38 defining a larger opening for second wire guide channels 45 relative to wire guide channels 33 to insure ease of entry of a wire 26 into a second wire guide channel 45 from an aligned wire guide channel 33. An alternative embodiment of the present invention can be constructed by forming fixture 21, as shown in FIG. 4, without exit bridge 48, with adjacent exit walls 47 defining wire positioning slots which laterally position each respective wire therein. Preferably, as seen in FIGS. 15–18, a top entry edge 46 and side entry edges 52 of second wire guide channels 45 are formed with a rounded or beveled contour which corrects any misalignment of a wire in the upward or lateral directions as it is inserted into a second wire guide channel 45 or a wire positioning slot of the alternative embodiment. A wire inserted into a second wire guide channel 45 from an aligned wire guide channel 33 is guided into the correct second wire guide channel 45 by the combination of the relative lower position of exit bridge 48 and the rounded contour of top entry edge 46 and side entry edges 52.

A wire containment inset 50 is formed in the forward end of wire positioning fixture 21 to contain the distal ends of wires 26.

Figure 7:
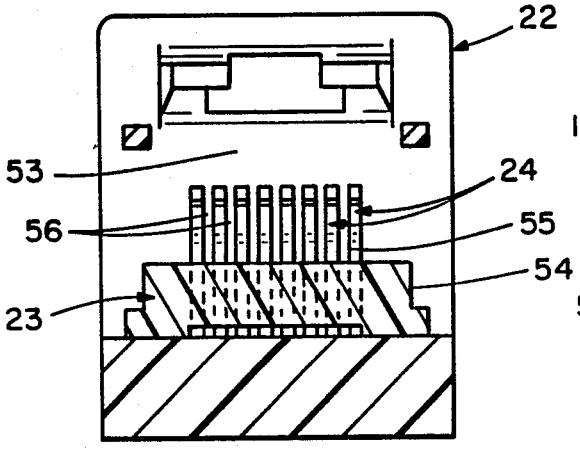
FIG. 7 is a sectional view taken along line 7—7 of FIG. 4.
Figure 8:
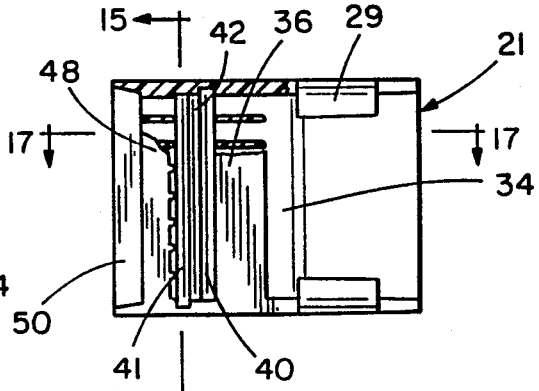
FIG. 8 is a bottom view partially in section of the inner surface of a wire positioning fixture of the telephone connector of FIG. 1.
Figure 9:
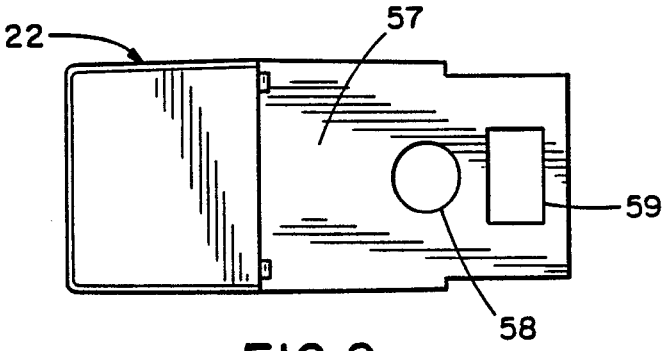
FIG. 9 is a plan of the housing of the connector of FIG. 1.

A free-standing jack housing 22 includes a jack socket 51 of a standard configuration for accepting a standard modular telephone plug. Socket 51 includes a back wall 53, seen in FIGS. 4 and 7, that defines a stepped profile slot 54 shaped to accurately accept and center contact carrier 23. Eight contact positioning channels 55 are formed by seven parallel walls 56 disposed on a lower edge of back wall 53. As seen in FIG. 3, housing 22 includes a carrier positioning surface 57 having a mounting aperture 58, and a carrier latch aperture 59.

Undercut side slots 60 are formed along side edges at the rear end of housing 22.

An alternate embodiment of connector 20 is depicted in FIGS. 11–14 and is designated 20A. Connector 20A is identical to connector 20 in all respects except that housing 22A does not include a mounting aperture and is specially constructed with an increased height and length to include mounting pad 61 and mounting slot 62 such that connector 20A can be interchangeably mounted as a component in a communication box assembly described in U.S. Pat. No. 4,875,881 assigned to a common assignee, which is incorporated herein by reference.

As seen in FIGS. 3, 4 and 10, contact carrier 23 includes a plurality of contact positioning slots 64 in an insertion end of contact carrier 23 and positioning flanges 65 configured for receipt within slot 54 of housing 20 to accurately center contacts 24 carried on contact carrier 23 with respect to contact positioning slots 64. A plurality of contact apertures 66 are formed through the thickness of contact carrier 23 in first and second staggered rows. A mounting aperture 67 is formed through the thickness of the contact carrier 23 and is disposed to align with housing mounting aperture 58 to allow a screw fastener (not shown) to be inserted through both apertures to secure connector 20 to a mounting surface. After fastening of assembled housing 22 and contact carrier 23 to a mounting surface, wire positioning fixture 21 is locked by engagement of latch arms 29 with undercut side slots 60 preventing access to the screw fastener and thus preventing removal of connector 20 from the mounting surface.

Tapering latch guide surfaces 68 are provided at rearward side edges of contact carrier 23 disposed to align with latch arms 29 of wire positioning fixture 21. Cable positioning walls 69 are disposed at a rearward end of contact carrier 23 with a strain relief ridge 70 disposed therebetween. Strain relief ridge 70 and positioning walls 69 are disposed to engage the sheath of a terminated telephone cable 25 to provided strain relief to an assembled connector 20. An inset contact positioning surface is formed in the bottom surface of contact carrier 23 to accept the thickness of the intermediate portion of contacts 24. As seen in FIG. 4, a carrier latch 73 formed on the bottom rearward surface of contact carrier 23 is disposed to latch within carrier latch aperture 59 of housing 22.

Figure 6:
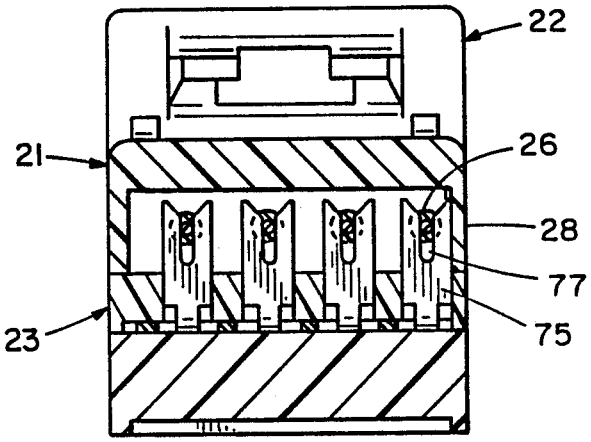
FIG. 6 is a sectional view taken along line 6—6 of FIG. 4.

As seen in FIGS. 4, 6 and 10 contacts 24 include a resilient cantilever portion 74 for resilient engagement of the terminals of a modular telephone plug, an insulation displacement portion 75 having an insulation displacement slot 77, and an intermediate portion 78 joining cantilever portion 74 and insulation displacement portion 75. Contacts 24 are assembled to contact carrier 23 with an insulation displacement portion positioned in each contact aperture 66 forming contact rows 43 and 44 disposed in a staggered array which minimizes the overall width of the array and connector 20. Contact carrier 23 is then inserted into housing 22 until latch 73 enters aperture 59 to lock carrier 23 to housing 22.

Wires 26 are terminated to assembled housing 22, contacts 24 and contact carrier 23 of connector 20 by inserting eight individual wires of telephone cable 25 through aligned wire guide channels 33 and 45 of wire positioning fixture 21, severing the ends of wires adjacent wire containment inset 50 and manipulating wire positioning fixture 21 to align latch arms 29 with latch guide surfaces 68 of contact carrier 23 secured within housing 22, and manually forcing fixture 21 into latching engagement with carrier 23 and housing 22.

While the particular preferred embodiments of the present invention have been shown and described, it will be obvious to those skilled in the art that changes and modifications may be made without departing from the teachings of our invention. Specifically, it should be noted that the disclosed telephone connector can be modified to terminate any number of a plurality of conductors. In addition, the insulation portion 75 of contacts 24 may be arranged in a single row or in a plurality of rows either in parallel alignment or in a non-parallel configuration.

We claim:

1. A telephone connector adapted for termination of a plurality of telephone wires, comprising:

a housing adapted to mate with a standard telephone connector;

a plurality of metal contacts each having a first portion adapted to conductively engage corresponding terminals of the standard telephone connector and an insulation displacement portion adapted to terminate one of the telephone wires;

contact carrier means for mounting the contacts to the housing with the insulation displacement portions disposed outwardly of the housing arranged in a plurality of spaced apart contact rows on an upper surface of the contact carrier means; and fixture means for positioning the wires with respect to the insulation displacement portions, the fixture means including a plurality of first wire guide channels formed in a first row on an inner surface of the fixture means, a plurality of second wire guide channels formed in a second row on the inner surface parallel to and spaced from the first row defining a continuous contact accepting slot therebetween, with the first and second wire guide channels in alignment to successively accept and position each wire for engagement with and termination to the insulation displacement portions of the contacts, anvil means for forcing the wires into conductive engagement with each respective insulation displacement portion, the anvil means formed on the inner surface of the fixture means between spaced apart first and second wire guide channels in a position to project between adjacent rows of insulation displacement portions and fastening means for securing the fixture means to the connector with the insulation displacement portion of each contact disposed in alignment with and between an aligned pair of first and second wire guide channels in a position to terminate a wire positioned in the first and second wire guide channels.

2. A telephone connector as set forth in claim 1, including aperture means formed in the connector on a surface enclosed by the fixture means after assembly of the fixture means to the connector such that a screw fastener can be inserted through the aperture means to secure the connector to a mounting surface before assembly of the fixture means to the connector.

3. A telephone connector as set forth in claim 1, wherein the first and second wire guide channels have a rectangular profile and wherein the contact rows are disposed in a staggered array whereby the width of the connector is minimized.

4. A telephone connector as set forth in claim 3, wherein the first wire guide channels taper from a first height of sufficient dimension to facilitate insertion of the wires therein to a second height of lesser dimension that accurately positions the wires for subsequent insertion into the second wire guide channels and wherein the second wire guide channels have a height greater than the second height of the first wire guide channels such that each wire is easily inserted through the first wire channel, past the continuous slot therebetween and into the second wire guide channel.

5. A telephone connector as set forth in claim 4, wherein the fastening means includes opposing resilient latch arms formed on outer peripheral edges of the fixture means having locking slots formed at the distal ends of each latch arm and a corresponding pair of side slots formed on the contact carrier means disposed to lockingly engage respective locking slots of the latch arms to secure the fixture means to the connector.

6. A telephone connector as set forth in claim 5, wherein the contact carrier means includes latch guide surfaces disposed to position and guide latch arms into engagement with the contact carrier means.

7. A telephone connector as set forth in claim 6, wherein the anvil means is formed by two spaced apart contact slots formed in the inner surface of the wire positioning fixture.

8. A telephone connector as set forth in claim 7, wherein the contact carrier means is formed separately from the housing and including means for latching the contact carrier means to the housing.

9. A telephone connector adapted for termination of a plurality of telephone wires, comprising:

a housing adapted to mate with a standard telephone connector;

a plurality of metal contacts each having a first portion adapted to conductively engage corresponding terminals of the standard telephone connector and an insulation displacement portion adapted to terminate one of the telephone wires;

contact carrier means for mounting the contacts to the housing with the insulation displacement portions disposed outwardly of the housing arranged in a plurality of spaced apart contact rows on an upper surface of the contact carrier means;

fixture means for positioning the wires with respect to the insulation displacement portions, the fixture means including a plurality of first wire guide channels formed in a first row on an inner surface of the fixture means, a plurality of second wire guide channels formed in a second row on the inner surface parallel to and spaced from the first row defining a continuous contact accepting slot therebetween, with the first and second wire guide channels in alignment to successively accept and position each wire for engagement with and termination to the insulation displacement portions of the contacts, anvil means for forcing the wires into conductive engagement with each respective insulation displacement portion, the anvil means formed on the inner surface of the fixture means with a distal edge of the anvil means in alignment with exit surfaces of the first wire guide channels and entry surfaces of the second wire guide channels, with a surface of the anvil means adjacent the first wire guide channel formed with a rounded contour whereby a wire inserted through the first wire guide channel is guided into the second wire guide channel, and with the anvil means disposed between spaced apart first and second wire guide channels in a position to project between adjacent rows of insulation displacement portions, and fastening means for securing the fixture means to the connector with the insulation displacement portion of each contact disposed in alignment with and between an aligned pair of first and second wire guide channels in a position to terminate a wire positioned in the first and second wire guide channels; and wherein the first wire guide channels taper from a first height of sufficient dimension to facilitate insertion of the wires therein to a second height of lesser dimension that accurately positions the wires for subsequent insertion into the second wire guide channels and wherein the second wire guide channels have a height greater than the second height of the first wire guide channels such that each wire is easily inserted through the first wire guide channel, past the continuous slot therebetween and into the second wire guide channel.

10. A telephone connector as set forth in claim 9, wherein the first and second wire guide channels have a rectangular profile and wherein side and top entry edges of the second wire guide channels are formed with a rounded contour to facilitate insertion of a wire into the second wire guide channels.

11. A telephone connector as set forth in claim 10, wherein the fastening means includes opposing resilient latch arms formed on outer peripheral edges of the fixture means having locking slots formed at the distal ends of each latch arm and a corresponding pair of side slots formed on the contact carrier means disposed to lockingly engage respective locking slots of the latch arms to secure the fixture means to the connector.

12. A telephone connector as set forth in claim 11, wherein the contact carrier means includes latch guide surfaces disposed to position and guide latch arms into engagement with the contact carrier means.

13. A telephone connector as set forth in claim 12, wherein the anvil means is formed by two spaced apart contact slots formed in the inner surface of the wire positioning fixture.

14. A telephone connector as set forth in claim 13, wherein the contact carrier means is formed separately from the housing and including means for latching the contact carrier means to the housing.

15. A telephone connector as set forth in claim 14, including aperture means formed in the connector on a surface enclosed by the fixture means after assembly of the fixture means to the connector such that a screw fastener can be inserted through the aperture means to secure the connector to a mounting surface before assembly of the fixture means to the connector.

16. A telephone connector adapted for termination of a plurality of telephone wires, comprising:

a housing adapted to mate with a standard telephone connector;

a plurality of metal contacts each having a first portion adapted to conductively engage corresponding terminals of the standard telephone connector and an insulation displacement portion adapted to terminate one of the telephone wires;

contact carrier means for mounting the contacts to the housing with the insulation displacement portions disposed outwardly of the housing arranged in a plurality of spaced apart contact rows on an upper surface of the contact carrier means; and fixture means for positioning the wires with respect to the insulation displacement portions, the fixture means including a plurality of first wire guide channels formed in a first row on an inner surface of the fixture means, a plurality of parallel, spaced apart walls formed in a second row on the inner surface of the fixture means with each pair of adjacent walls defining an open wire positioning slot such that a wire is free to move away from a top entry edge without interference in an insertion direction, the second row of walls formed parallel to and spaced from the first row of first wire guide channels to define a continuous contact accepting slot therebetween, with the first wire guide channels and the wire positioning slots formed in alignment to successively accept and position each wire for engagement with and termination to the insulation displacement portions of the contacts, anvil means for forcing the wires into conductive engagement with each respective insulation displacement portion, the anvil means formed on the inner surface of the fixture means between the spaced apart, adjacent first wire guide channel and wire positioning slot rows in a position to project between adjacent rows of insulation displacement portions and fastening means for securing the fixture means to the connector with the insulation displacement portion of each contact disposed in alignment with and between an aligned pair of first wire guide channels and wire positioning slots in a position to terminate a wire positioned therein.

17. A telephone connector as set forth in claim 16, including aperture means formed in the connector on a surface enclosed by the fixture means after assembly of the fixture means to the connector such that a screw fastener can be inserted through the aperture means to secure the connector to a mounting surface before assembly of the fixture means to the connector.

18. A telephone connector as set forth in claim 16, wherein a bridge encloses the wire positioning slots to form second wire guide channels, with the bridge positioned below the first wire guide channels such that each wire is easily inserted through the first wire guide channel and into the second wire guide channel.

19. A telephone connector as set forth in claim 18, wherein the first wire guide channel has a rectangular profile, wherein the contact rows are disposed in a staggered array whereby the width of the connector is minimized and wherein the first wire guide channels taper from a first height of sufficient dimension to facilitate insertion of the wires therein to a second height of lesser dimension that accurately positions the wires for subsequent insertion into the wire positioning slots.

20. A telephone connector as set forth in claim 19, wherein the fastening means includes opposing resilient latch arms formed on outer peripheral edges of the fixture means having locking slots formed at the distal ends of each latch arm and a corresponding pair of side slots formed on the contact carrier means disposed to lockingly engage respective locking slots of the latch arms to secure the fixture means to the connector.

21. A telephone connector as set forth in claim 20, wherein the contact carrier means includes latch guide surfaces disposed to position and guide latch arms into engagement with the contact carrier means.

22. A telephone connector as set forth in claim 21, wherein the anvil means is formed by two spaced apart contact slots formed in the inner surface of the wire positioning fixture and wherein a surface of the anvil means adjacent the first wire guide channels is formed with a rounded contour whereby a wire inserted through one of the first wire guide channels is guided into one of the second wire guide channels.

23. A telephone connector as set forth in claim 22, wherein the contact carrier means is formed separately from the housing and including means for latching the contact carrier means to the housing.

24. A telephone connector adapted for termination of a plurality of telephone wires, comprising:

a housing adapted to mate with a standard telephone connector;

a plurality of metal contacts each having a first portion adapted to conductively engage corresponding terminals of the standard telephone connector and an insulation displacement portion adapted to terminate one of the telephone wires;

contact carrier mean for mounting the contacts to the housing with the insulation displacement portions disposed outwardly of the housing; and fixture means for positioning the wires with respect to the insulation displacement portions, the fixture means including a plurality of first wire guide channels formed in a first row on an inner surface of the fixture means and a plurality of parallel, spaced apart walls formed in a second row on the inner surface of the fixture means with each pair of adjacent walls defining an open wire positioning slot such that a wire is free to move away from a top entry edge without interference in an insertion direction, with the first wire guide channels and wire positioning slots in alignment to successively accept and position each wire for engagement with and termination to the insulation displacement portions of the contacts, and fastening means for securing the fixture means to the connector with the insulation displacement portion of each contact disposed in alignment with and between an aligned pair of the first wire guide channels and wire positioning slots in a position to terminate a wire positioned in the channel and slot pair, wherein side and top entry edges of the wire positioning slot are contoured to facilitate insertion of a wire into the wire positioning slots.

25. A telephone connector as set forth in claim 24, wherein a bridge encloses the wire positioning slots to form second wire guide channels, with the bridge positioned below the first wire guide channels such that each wire is easily inserted through the first wire guide channel and into the second wire guide channel.

26. A telephone connector as set forth in claim 25, wherein the first and second wire guide channels have a rectangular profile and wherein the first wire guide channels taper from a first height of sufficient dimension to facilitate insertion of the wires therein to a second height of lesser dimension that accurately positions the wires for subsequent insertion into the second wire guide channels.

27. A telephone connector as set forth in claim 26, wherein the fastening means includes opposing resilient latch arms formed on outer peripheral edges of the fixture means having locking slots formed at the distal ends of each latch arm and a corresponding pair of side slots formed on the contact carrier means disposed to lockingly engage respective locking slots of the latch arms to secure the fixture means to the connector.

28. A telephone connector as set forth in claim 27, wherein the contact carrier means includes latch guide surfaces disposed to position and guide latch arms into engagement with the contact carrier means.

29. A telephone connector as set forth in claim 28, wherein the contact carrier means is formed separately from the housing and including means for latching the contact carrier means to the housing.

30. A telephone connector as set forth in claim 29, wherein the housing includes mounting pad means and mounting slot means formed along opposite edges of the housing for mounting the connector as a component in a communication box assembly.

31. A telephone connector as set forth in claim 29, including aperture means formed in the connector on a surface enclosed by the fixture means after assembly of the fixture means to the connector such that a screw fastener can be inserted through the aperture means to secure the connector to a mounting surface before assembly of the fixture means to the connector.

* * * * *